United States Patent [19]

Weatherby

[11] 4,124,983

[45] Nov. 14, 1978

[54] CORROSION PROTECTED EARTH TIEBACK

[75] Inventor: David E. Weatherby, Rockville, Md.

[73] Assignee: Schnabel Foundation Company, Washington, D.C.

[21] Appl. No.: 754,515

[22] Filed: Dec. 27, 1976

[51] Int. Cl.[2] ..... E02D 5/00

[52] U.S. Cl. ..... 405/260; 405/262

[58] Field of Search ..... 61/39, 53, 54, 45 B; 52/155

[56] References Cited

U.S. PATENT DOCUMENTS 3,448,585 6/1969 Vogelsang ..... 61/54

FOREIGN PATENT DOCUMENTS 958,237 11/1974 Canada ..... 61/39

2,019,166 11/1971 Fed. Rep. of Germany ..... 61/39

1,408,502 10/1975 United Kingdom ..... 61/39

*Primary Examiner*—Mervin Stein

*Assistant Examiner*—David H. Corbin

*Attorney, Agent, or Firm*—Schuyler, Birch, Swindler, McKie & Beckett

[57] ABSTRACT

An earth tieback comprising a steel tendon rod anchoring a structure to the earth, the tendon rod having double corrosion protection provided first by a thin hard coating of corrosion resistant plastic throughout its length and second by concrete grout over the anchor zone of the rod and by a heat shrunk plastic tube tightly encapsulating the unbonded zone of the rod.

6 Claims, 6 Drawing Figures

FIG. 2
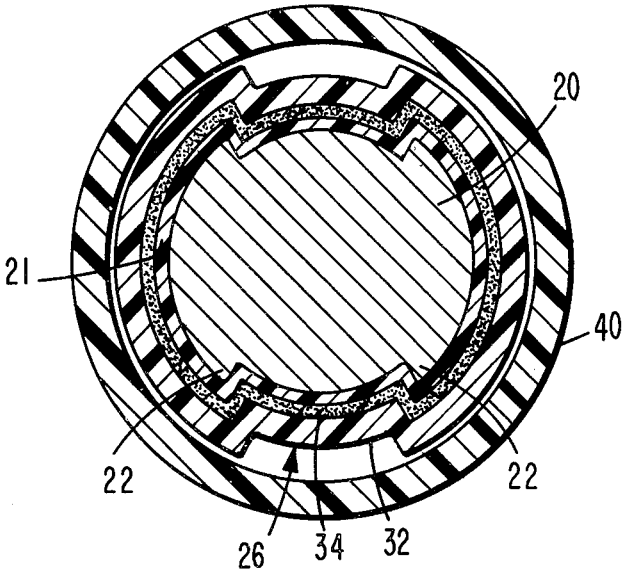
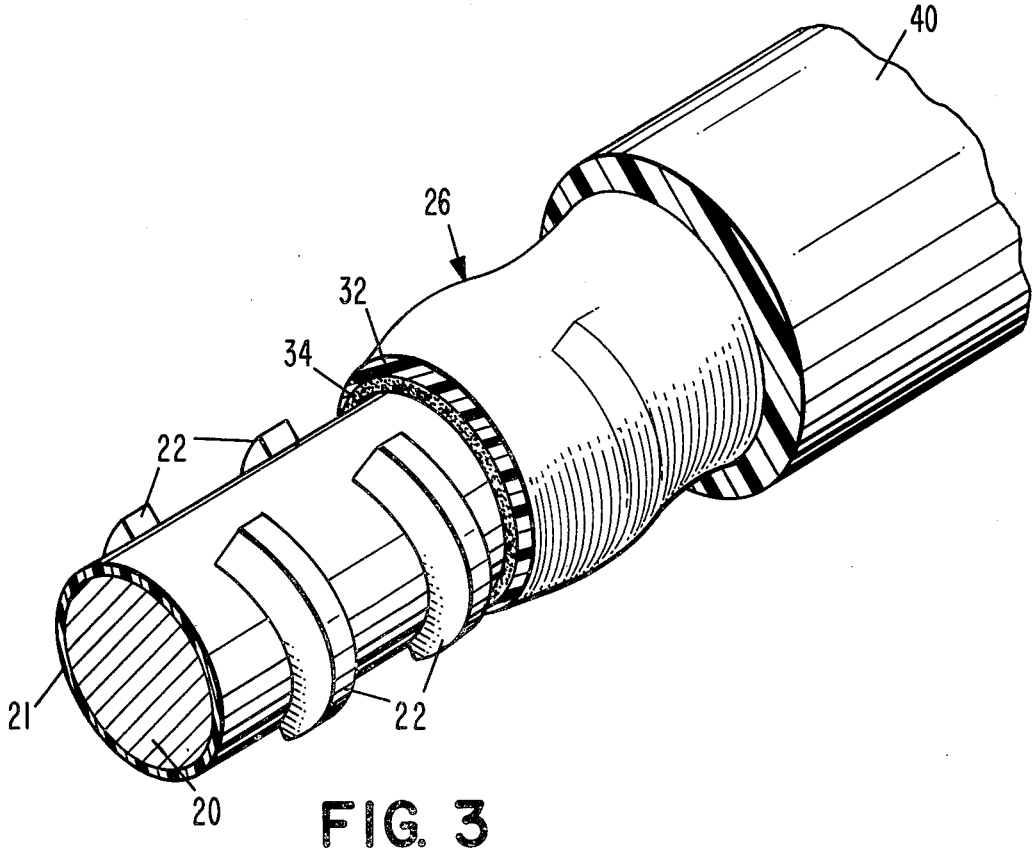
FIG. 3

CORROSION PROTECTED EARTH TIEBACK

BACKGROUND OF THE INVENTION

1. Field of the Invention

The present invention relates generally to earth tiebacks and, more particularly, to tendon rods protected from corrosion and adapted to be permanently left in place and a method of installing such a tieback in the ground.

2. Description of the Prior Art

Earth tiebacks, also generally referred to as earth anchors, are often used in the construction industry to support or anchor various structures in the ground. For example, they are used to support retaining walls bordering highways or to support excavation sheeting to prevent cave-ins which would otherwise endanger lives and property. Such tiebacks generally comprise a steel tendon rod installed in the ground and secured at its outer end by an anchor head structure to an excavation sheeting system or other structure to be supported. A concrete anchor is formed around the inner end of the tendon to distribute to the surrounding soil forces applied to the tendon. An example of a typical tieback is illustrated in U.S. Pat. No. 3,490,242.

When constructing permanent structures, it is often necessary to leave the tiebacks in place rather than remove them, thus giving rise to a need for a tieback which does not corrode when exposed to ground water or the like. Anchor tendon rods are normally manufactured from high strength prestressing steel which corrodes very rapidly when not protected.

U.S. Pat. No. 3,753,354 is one example of a corrosion protected tieback comprising a tubular plastic pipe placed around the tendon. The complex structure of this patent is expensive and requires great care in manufacture. Moreover, it requires a large diameter anchor hole which necessitates expensive drilling equipment and techniques. Other conventional attempts at corrosion protection using tubular plastic pipe over the unbonded zone of the tendon leave open space between the pipe and the tendon susceptible to the influx of water with resultant corrosion. It is difficult to securely seal the ends of the pipe to prevent water from reaching the enclosed tendon thus increasing the complexity and cost in manufacturing the tieback.

It has also been known to install plastic or metal pipe over tieback tendons in the unbonded zone and to fill the space between the pipe and the tendon with grease or other corrosion barrier. However, it is difficult to uniformly inject the grease around the tendon, particularly a ribbed tendon and the anchor zone is protected only by the grout. Further, the expense is increased due to the added cost of the grease and its injection. In addition, the diameter of the tieback is significantly enlarged requiring that a larger hole be drilled or driven into the ground to receive the tendon. It necessarily becomes more expensive to install such tiebacks since bigger and more powerful drilling equipment must be employed.

Earth tiebacks have also been protected from corrosion by a coating of epoxy applied by hand painting or dipping. However, such coatings have been unsuccessful because of nonuniformity of application and vulnerability to abrasion, chipping cracking. Another method of protecting anchor rods generally is that shown in U.S. Pat. No. 3,675,381 to Watson who uses a coating of an asphalt mastic to electrically insulate an anchor rod from a metallic anchor portion and the surrounding soil to prevent electrolytic corrosion. However, the application of the mastic to the anchor rod of Watson is difficult and time consuming due to its pasty nature and also requires the use of a sleeve around the mastic coating to protect the clothes of any person who might come into contact with the coated rod.

SUMMARY OF THE INVENTION

Accordingly, it is an object of the present invention to overcome the above-noted disadvantages of the prior art by providing a corrosion protected earth tieback which is inexpensive, simple to manufacture and easy to install.

It is a further object of the present invention to provide a corrosion protected earth tieback tendon rod which may be conveniently shipped from a manufacturing plant to its place of use in a container which at least partially forms a portion of the tieback.

These and other objects of the invention are accomplished by providing an earth tieback for anchoring a structure to the ground comprising an elongated tendon rod anchoring the structure to the ground and covered by a corrosion resistant system. The elongated tendon rod is secured at its outer end to the structure to be supported and extends into the ground where its inner end is anchored. The tendon rod has a thin hard coating of corrosion resistant plastic material of substantially uniform thickness covering an inner anchor zone of the rod in the ground and an outer unbonded zone of the rod extending from the anchor zone out of the ground. A grout anchor is embedded within the ground and covers the anchor zone of the coated tendon rod in bonded relation thereto. A heat shrunk plastic tube covers the coated tendon rod over the unbonded zone, such tube being tightly shrunk to snugly encase the tendon rod in substantially void-free relation thereto. Thus, the tendon rod is doubly protected from corrosion in the anchor zone by the coating and the grout anchor and in the unbonded zone by the coating and the plastic tube. The coated tendon rod covered by the heat shrunk tubing may be shipped to the job site encased in a second protective plastic tube. That portion of the protective tube over the tendon in the area where the concrete anchor will be formed is stripped away and discarded while the rest of the tube is left in place covering the heat shrunk plastic tube to provide a smooth surface thereover.

BRIEF DESCRIPTION OF THE DRAWINGS

The novel features of the invention are set out with particularity in the appended claims, but the invention will be understood more fully and clearly from the following detailed description of a preferred embodiment as set forth in the accompanying drawings, in which:

FIG. 2 is a cross-sectional view of the tieback anchor tendon along line 2—2 of FIG. 1;

FIG. 3 is a perspective view of a portion of the tieback anchor tendon according to the present invention.

DESCRIPTION OF A PREFERRED EMBODIMENT

Figure 1:
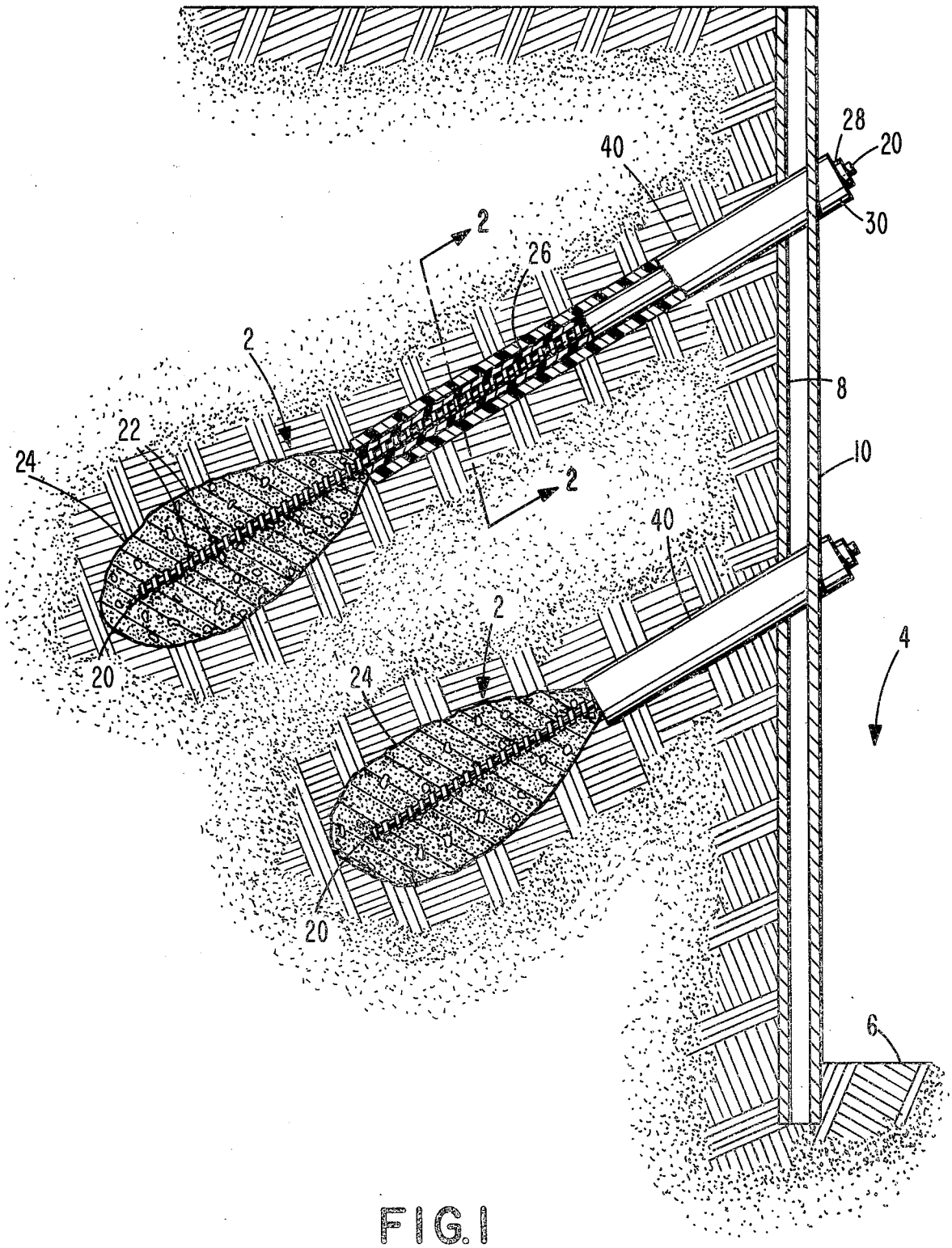
FIG. 1 is a cross-sectional view of two earth tiebacks according to the present invention installed behind an excavation sheeting system.

Referring to FIG. 1, two earth tiebacks 2 according to the present invention are shown installed along one wall of an excavation 4 having a bottom surface 6 and a vertical wall 8 extending upwardly from the bottom surface 6 to ground level. Vertical wall 8 is prevented from collapsing by a conventional excavation sheeting system 10 which abuts the face of the wall 8 and is retained in place by the tiebacks 2. Sheeting system 10 may be of any type suitable to retain the wall 8 from collapsing such as that shown in U.S. Pat. No. 3,490,242 comprising horizontally disposed boards held in place by vertical piles. Although the earth tiebacks 2 of the present invention are being described in conjunction with excavation sheeting 10, such tiebacks 2 can also be used where appropriate to anchor to the ground other structures, such as bridge abutments, retaining walls, building slabs, and the like. The term earth is used in a broad sense and is intended to include either soil or rock or a combination of the two.

Each tieback anchor 2 comprises a steel tendon 20 anchored between the earth and a structure to be supported, the tendon being covered by a corrosion protection system. Tendon 20 is usually a prestressing steel rod of the type conventionally used in the construction industry. Commonly such rods embody a plurality of axially spaced ribs extending partially around the circumference of the rod 20. Such ribs usually take the form of an interrupted helix.

A grouted anchor 24, formed of a hardenable or settable material, preferably concrete, is attached to the inner end of the tendon rod 20. The grouted anchor 24 contacts the surrounding ground to distribute thereto the forces occurring on tendon rod 20. Steel tendon 20 is protected against corrosion by a coating 21 over the entire length of the tendon, by the grouted anchor 24 over the anchor zone of the tendon, and by a heat shrinkable tube 26 shrunk snugly around the coated tendon in its unbonded zone or free length above the position of the anchor 24. Thus, the steel tendon 20 is doubly protected from corrosion throughout its length thereby making tieback anchor 2 suitable for use in a permanent installation. The outer end of tendon 20 extends through the sheeting system 10 and an anchor head structure 30 compatible with the tendon transfers the force in the tendon to the excavation sheeting system 10.

Referring to FIGS. 2 and 3, the coating 21 protects the entire tendon 20 and heat shrinkable tube 26 protects the unbonded zone of the tendon. Tendon rod 20 is first coated over its entire length by corrosion resistant coating 21 of uniform thickness before the heat shrinkable tube 26 is applied to the unbonded zone of the rod. Preferably, the coating 21 is an electrostatically applied epoxy resin forming a uniform coating not more than 20 mils in thickness of a type conventionally used on steel reinforcing rods for concrete. Such a coating permits the rod to pass a conventional creep test which indicates satisfactory transfer of the bond from the rod to the concrete through the coating.

The tube 26 may comprise any of a number of commercially available tubings of heat shrinkable polymeric materials. Preferably, the tubing has an outer heat shrinkable polymeric layer 32 lined with a meltable thermoplastic adhesive which when heated completely encapsulates the rod without leaving any voids. One acceptable tubing is an irradiated polyolefin lined with an thermoplastic adhesive. Another acceptable tubing is known as Thermofit Shrink Sleeves manufactured by the Raychem Corporation, Menlo Park, California, to protect pipe line joints and electrical splices from corrosion. Such tubing utilizes an irradiated heat shrinkable polyethylene plastic having its inner lining of mastic. The adhesive lining of tubing 26 is shown at 34.

Heat shrinkable tube 26 is generally slipped over the tendon rod 20 and then shrunk thereon by means of a portable blow torch (not shown) or any other suitable heat source. The length of tube 26 needed to cover the unbonded zone of tendon rod 20 will vary depending on the job requirements and the length of the grout anchor 24. It is, therefore, generally necessary to apply the heat shrinkable tube 26 to the tendon 20 on a custom basis for each job after the dimension and orientation of the tieback 2 is known. As the tube 26 is shrunk onto the tendon rod 20, the elastic adhesive 34 melts or softens and the plastic tubing 32 shrinks tightly over the tendon 20 to completely encase the ribs 22 and the grooves formed between the ribs 22 on the rod 20 thereby causing tube 26 to assume the general configuration of the ribs 22 as shown in FIGS. 2 and 3.

Because tube 26 snugly adheres to tendon 20 in substantially void free relation, it assumes the general configuration characteristics of its surface. The exterior of the tube 26 thus has an undulating surface over the ribbed rod 20. To compensate for such undulations, a hollow protective tube 40 having a sliding fit with the heat shrunk tube 26 is placed over tendon 20 to provide a smooth cylindrical outer surface over the unbonded portion of tendon 20. Such a smooth outer surface is needed to break the bond and minimize the friction occurring between the unbonded zone of tendon 20 and the earth around it. Because the earth around that zone of the tendon is not intended to bear any of the load occurring on tieback 2, the absence of bond is important. In the unbonded zone, the tendon must be free to deform longitudinally under load. Tube 40 also mechanically protects the heat shrunk tube 26 from damage which would allow seepage of water or other corrosive agents through the tube to reach the tendon rod 20. Although it is preferred that the outer protective tube 40 be made of plastic, any type of suitable material could be used.

In addition to providing a smooth outer surface over the unbonded zone of the tendon 20, outer protective tube 40 also forms a protective shipping tube for tendon rod 20. In this case, the heat shrinkable tube 26 is first applied to the unbonded zone of the tendon rod 20 and then the entire length of rod 20 is covered by the protective tube 40 for transportation between the place of manufacture and the job site. When the tendon 20 arrives at the job site, the portion of the protective tube 40 covering that portion of tendon 20 which will be covered by the concrete anchor 24 is stripped away and discarded leaving tube 40 only over the heat shrunk tubing 26 previously applied to the unbonded zone of the tendon. Tieback 2 is then installed into the ground to anchor the excavation sheeting in a generally conventional manner.

Figure 4:
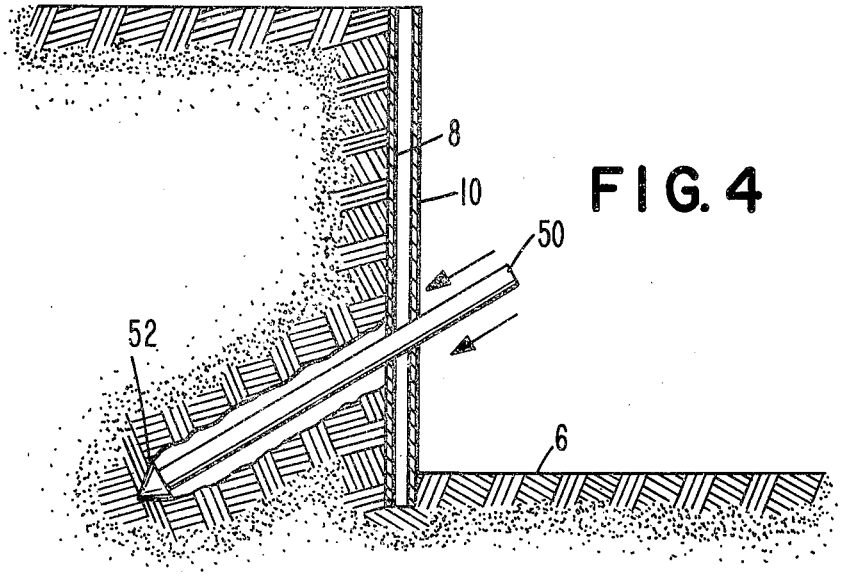
FIGS. 4–6 are side-elevational views of several steps in a method of installing a tieback according to the present invention behind excavation sheeting.
Figure 5:
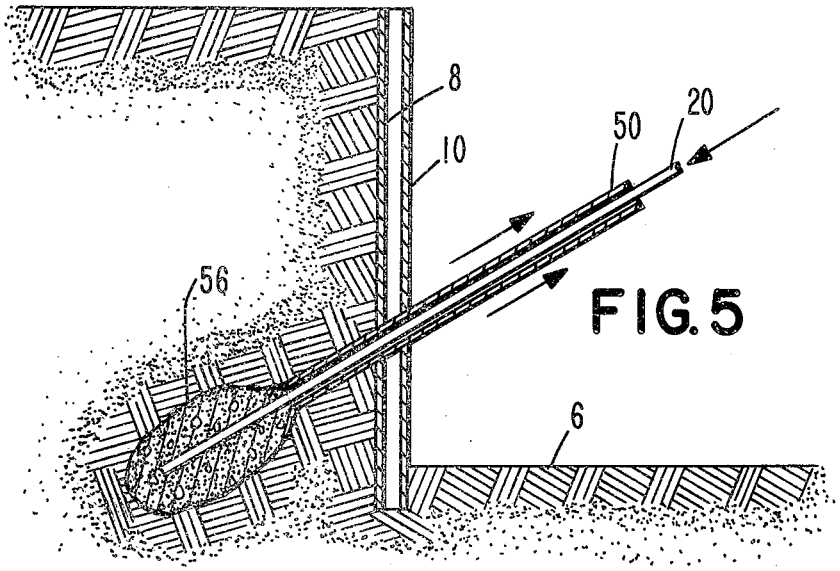
Figure 6:
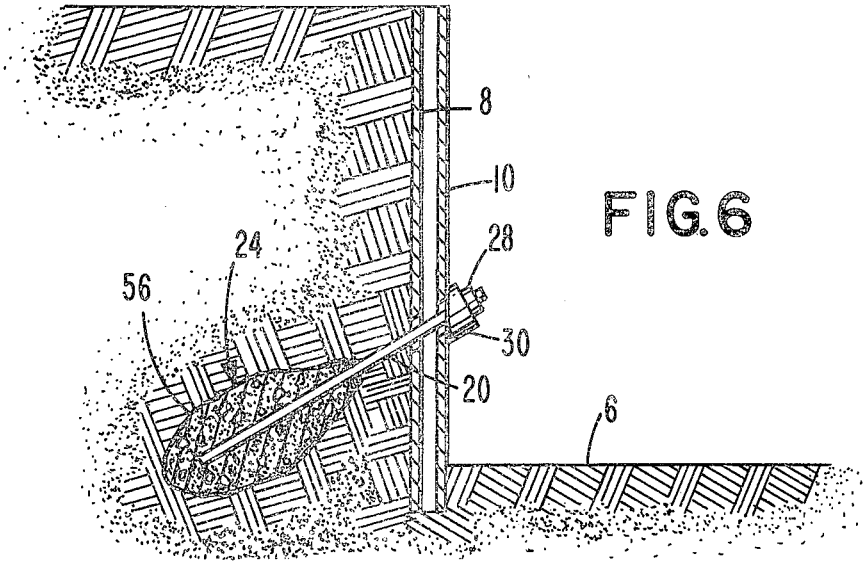

Referring now to FIGS. 4–6, a method for installing a tieback 2 according to the instant invention is illustrated. For purposes of clarity in showing the installation steps, the coating 21 and the tubes 26 and 40 are not illustrated but they are in place on the rod 20 as the rod is being installed. As shown in FIG. 4, a drill pipe 50 having a pointed bit 52 is driven or drilled by any appropriate means (not shown) into the side of the excavation wall 8, usually at a downwardly disposed angle as illustrated. Once the pipe 50 has been installed to a desired depth, the steel tendon rod 20 which forms a portion of the tieback 2 is inserted through the drill pipe 50 and is used to tamp against and knock off the bit 52 from the drill pipe 50. Subsequently, the bit 52 of drill pipe 50 will remain in the ground although it might possibly be retrieved if desired.

After the bit 52 of drill pipe 50 has been removed, the drill pipe 50 is withdrawn part of the distance which it had been previously inserted as shown in FIG. 5. With the tendon 20 extending down through drill pipe 50 into the ground and as the pipe 50 is withdrawn, a hardenable material 56 such as concrete grout, is injected through the drill pipe 50 to form an enlarged anchor 24 around the inner end of tendon 20. After the concrete 56 has hardened to form the concrete anchor 24 of tieback 2, drill pipe 50 may be removed entirely from the excavation wall 8 and the outer end of tendon 20 coupled to the anchor head structure 30 by the nut 28.

Although the present invention has been illustrated in terms of a preferred embodiment, it will be obvious to one of ordinary skill in the art that numerous modifications may be made without departing from the true spirit and scope of the invention. Therefore, the scope of the invention is to be limited only by the appended claims.

I claim:

1. An earth tieback for anchoring a structure to the ground comprising (a) an elongated tendon rod extending into the ground and having an inner anchor zone in the ground and an outer unbonded zone extending from said anchor zone out of the ground, said tendon rod having axially spaced ribs extending generally circumferentially thereof with grooves between said ribs, said rod having a thin hard coating of corrosion resistant plastic material of substantially uniform thickness covering the full lengths of said anchor zone and said unbonded zone;

(b) means for securing the outer end of said tendon rod to the structure to be supported;

(c) a grout anchor embedded within the ground in contact with and covering the full length of said anchor zone only of said coated tendon rod in bonded relation thereto;

(d) a plastic tube in contact with and covering said coated tendon rod over the full length of said unbonded zone only, said tube having a heat shrinkable outer layer and thermoplastic adhesive inner lining, said tube having said outer layer heat shrunk tightly about said tendon rod with said adhesive inner lining in contact with and snugly encasing said coated tendon rod in substantially void-free relation thereto, said outer layer having an undulating outer surface generally conforming to said ribs and said adhesive lining completely encasing said ribs and said grooves, whereby said tendon rod is doubly protected from corrosion in said anchor zone by said coating and said grout anchor and in said unbonded zone by said coating and said adhesively lined tube.

2. An earth tieback according to claim 1 further comprising a protective tube placed over said undulating heat shrunk tube to provide a smooth cylindrical surface thereover.

3. An earth tieback according to claim 1 wherein said outer layer of said heat shrunk plastic tube comprises a polymeric material.

4. An earth tieback according to claim 1 wherein said plastic coating is an electrostatic epoxy resin.

5. An earth tieback according to claim 4 wherein said epoxy resin coating is not greater than about 20 mils thick.

6. An earth tieback according to claim 5 wherein said outer layer of said heat shrunk plastic tube comprises a polymeric material.

* * * * *